United States Patent [19]

Marks

[11] 4,096,295

[45] Jun. 20, 1978

[54] METHOD FOR MULTIPLE COATINGS

[76] Inventor: Alvin M. Marks, 153-16 Tenth Ave., Whitestone, N.Y. 11357

[21] Appl. No.: 673,760

[22] Filed: Apr. 5, 1976

Related U.S. Application Data

[63] Continuation-in-part of Ser. No. 501,843, Aug. 29, 1974, abandoned.

[51] Int. Cl.[2] ..... B05C 11/12; C23C 13/08

[52] U.S. Cl. ..... 427/209; 427/346; 427/430 B; 427/439; 427/442; 427/443; 118/52; 118/53; 118/54; 118/55

[58] Field of Search ..... 118/52, 53, 54, 55; 427/346, 430 B, 439, 442, 443, 209

[56] References Cited

U.S. PATENT DOCUMENTS

| | | | |
|---|---|---|---|
| 2,009,232 | 7/1935 | Hood | 118/52 |
| 2,165,936 | 7/1939 | Miller | 118/52 |
| 3,494,326 | 2/1970 | Opton | 118/52 X |
| 3,619,865 | 11/1971 | Hazzard | 118/52 X |

FOREIGN PATENT DOCUMENTS

| | | | |
|---|---|---|---|
| 349,401 | 5/1931 | United Kingdom | 427/346 |

*Primary Examiner*—Michael R. Lusignan

[57] ABSTRACT

A plurality of articles such as sheets or lenses are simultaneously and uniformly coated by first placing them in vertical spaced relationship with respect to each other within a tank having a quantity of fluid coating material therein. The coating material flows across the surfaces to be coated. Thereafter, the sheets are lifted out of the tank into an elongated chamber above the tank in which they are spun about their vertical axes. Excess coating material is thus driven off the surfaces to be coated. Means to recover, clean, replenish and remove bubbles from the coating material are disclosed.

3 Claims, 2 Drawing Figures

METHOD FOR MULTIPLE COATINGS

This application is a Continuation-in-Part of an application for patent entitled "MACHINE AND METHOD FOR MULTIPLE COATINGS", Ser. No. 501,843, filed Aug. 29, 1974, by Alvin M. Marks, now abandoned.

BACKGROUND OF THE INVENTION

It is often desireable to coat flat sheets of transparent glass or plastic material or curved plastic or glass articles such as lenses, with abrasion resistant materials or colored compositions. Where the final product is required to be of optical quality, that is, free of dust particles,, uniform and free of bubbles, time consuming care and individual handling have been required. In addition, prior art coating techniques coated one side of the sheet or lens at a time resulting in an unsatisfactory number of rejects.

It is an object of the present invention to simultaneously coat both sides of a plurality of sheets or lenses with a minimum of hand operations.

Another object of the present invention is to substantially eliminate bubbles, foreign materials and irregularities from the coatings.

Still another object of the present invention is to increase the output of the coating process and recover excess fluid coating material, thereby reducing the cost of each coated article.

SUMMARY

In the present invention, a plurality of articles such as sheets or curved lenses of glass or plastic are secured within a rack in spaced relationship to each other along a common vertical axis. The loaded rack is lowered into a tank containing a fluid coating composition. The tank is rotated about its vertical axis by a source of rotary power causing the coating composition to flow in the same direction as the tank and pass across the major surfaces of the articles within the racks.

After the articles to be coated have been completely wetted by the coating composition the rack is drawn up out of the tank into a chamber which is open at its bottom to receive the rack and which overlies the tank. The rack is then spun about its vertical axis causing excess coating material to be driven outwardly and against the walls of the chamber.

The excess coating composition flows down the walls of the chamber and back into the tank. There remains a uniform coating upon both major surfaces of the articles within the rack. The coated articles may then be oven dried or air dried as desired.

DESCRIPTION OF THE DRAWING

In the accompanying drawing forming part hereof similar parts have been given identical reference numerals, in which drawings.

GENERAL DESCRIPTION

Figure 2:
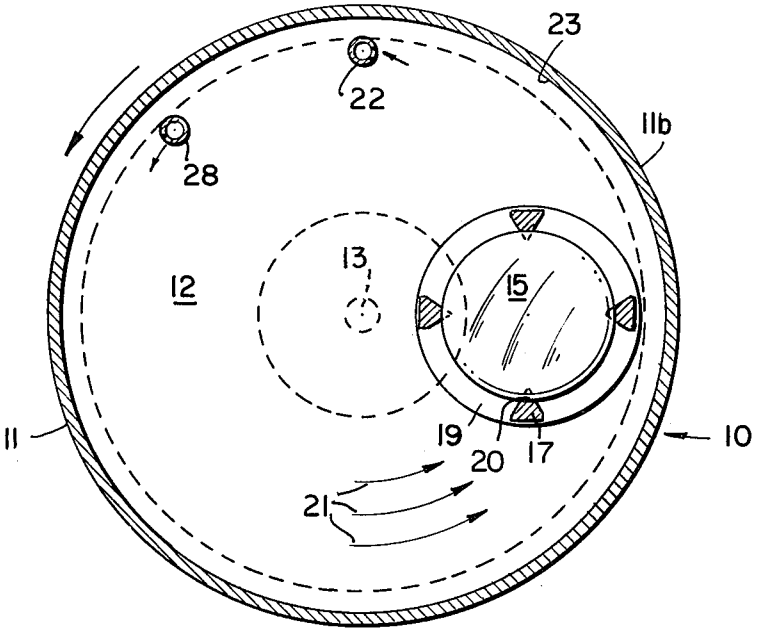
FIG. 2 is a cross sectional view taken on line 2—2 in FIG. 1 looking in the direction of the arrows.

Referring to the drawing, 10 indicates a device for the multiple coating of articles such as sheets, lenses or similar light transmitting pieces of glass, plastic or the like. A tank 11 having a bottom **11*a* and upstanding walls 11*b* contains a suitable quantity of a coating material 12 such as a polymer in a dissolved form having a viscosity of from 10 to 1,000 CPS. The tank 11 is secured to a table 11*c* which is mounted for rotation upon a shaft 13. The shaft 13 may be driven by a source of rotary power (not shown) to turn the tank about its vertical axis 14**.

As the tank 11 is rotated, frictional contact between the inner surfaces of the tank walls and the coating material 12 will cause the said material to take a circular flow path within the tank.

Figure 1:
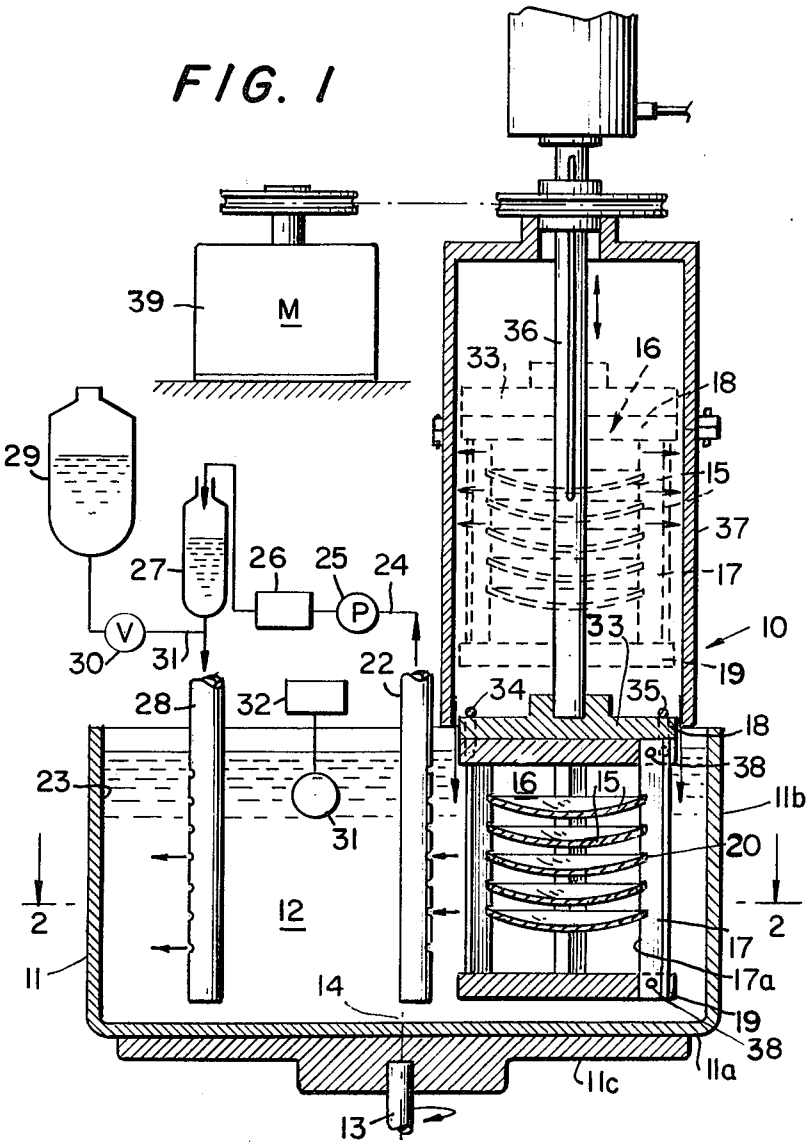
FIG. 1 is a somewhat diagrammatic view in vertical section of a complete embodiment of the present invention.

The articles to be coated 15 are placed within a rack 16 consisting of a plurality of elongated spaced upright jaws 17 carried between horizontally disposed top and bottom end plates 18, 19. The inner faces **17*a* of the jaws 17 are corrugated as indicated at 20 to receive the edges of the articles to be coated 15 and retain them in spaced relationship with respect to each other as shown in FIG. 1**. As many as 25 to 100 such articles may be held for coating in this manner.

It will be apparent that by removing one or more of the jaws 17 from the rack 16 by releasing pins 38 the articles 15 may be removed from or loaded on to the rack.

From an examination of FIGS. 1 and 2 it will be seen that the relative sizes of the tank 11 and rack 17 are such that the rack is carried off-center within the tank and in the path of flow of the fluid coating material 12. The coating material 12 flows over the major surfaces of the articles to be coated as indicated by the arrows 21 in FIG. 2. Any bubbles which may form in the coating material as the frame is dipped into or removed from the tank are swept off the major surfaces by the fluid and both top and bottom surfaces are wetted at the same time. It has been found that a tank rotation speed of from 5 to 50 RPM will prevent bubbles from forming due to cavitation as the coating material passes the rack and its contents for most coating materials.

To further maintain the coating material free of bubbles and foreign matter such as dirt particles a proportion of the coating material is continuously withdrawn by means of a perforated pipe 22 carried within the tank 11 adjacent the tank inner wall surface 23. Foreign matter and bubbles will be removed via pipe 22 as the fluid coating material rotates.

The pipe 22 is in communication with a fluid line 24 having a pump 25, a filter 26 and a debubbling reservoir 27 therein. The fluid line 24 ends in a second perforated pipe 28 carried within the tank 11 as shown in FIGS. 1 and 2. Additional fluid coating material 12 may be added to the tank 11 to replenish it from time to time by means of a reservoir 29 connected through a metering valve 30, to return line 31, to the second perforated pipe 28. A sensor float 31 coupled to a transducer 32 which controls the valve 30 in the well-known manner serves to keep the level of the coating material within the tank 11 substantially constant.

The rack 16 is releasably secured at its top to a flanged member 33 by latches 34, 35. The flanged member in turn is secured to a vertically shiftable shaft 36 which extends upwardly within a hollow chamber 37. The shaft 36 is coaxial with the vertical axis of the rack 16. A source of rotary power 39 such as an electric motor is operatively coupled to the shaft 36 to rotate the shaft and the rack attached thereto about the vertical axis so that excess coating material upon the articles held by the rack are spun off. There remains a uniform thin bubble-free and dirt-free coating upon the upper and lower major surfaces of each article 15 in the rack. It has been found that rotational speeds of from 300 to 3000 RPM are suitable for this purpose. The spinning operation requires 5–20 seconds depending upon the viscosity of the coating material and the desired thickness of the coating on the finished articles 15.

The excess coating material strikes the inner surfaces of the chamber 37 and flows downwardly into the tank 11 below the chamber 37 where it is reused in subsequent coating operations.

The chamber 37 is preferably made of two elongated plates of semicircular cross section, hinged together along one set of adjacent margins and latched together at their opposite margins. In this manner, the chamber 37 can be opened and closed for loading or unloading racks of articles in carrying out the coating process.

The operation of the present device will be apparent from the foregoing description to be as follows.

With the tank 11 filled to the proper height with coating material the tank is rotated until the coating material reaches its desired angular velocity. Articles to be coated are loaded into the rack in spaced relationship and the rack latched on to the flanged member within the chamber 37. Thereafter the rack is lowered into the coating material within the tank until all the articles are uniformly wetted. The rack is next lifted out of the coating material by raising the shaft 36 until the rack is within the chamber 37. The rack is then spun about its vertical axis for about 5–20 seconds until the excess coating material is spun off. The rack with its coated articles may be removed from the chamber by releasing the latches 34, 35 and the articles air dried or oven dried before removing them from the rack. Alternatively, the articles may be removed from the rack before drying. During the drying step, other racks may be loaded, inserted in the chamber and the entire cycle repeated.

Various modifications of the above disclosed invention may be made without departing from the scope of this invention.

For example, various other means of dipping, spacing and supporting the lenses 15 may be employed; and, referring to FIG. 2, the lenses 15 may be supported in a suitable spacing and supporting device such as the rack 16 shown, and may be dipped with the axis of the lenses coincident to the center of the container 10. The container 10 may be stationary. The input pipe 28 may be located as shown, but the exit pipe 22 may be arranged diametrically opposite. In such case, the liquid flow lines 21 will proceed across the diameter of the stationary chamber, pass through the spaces between the lenses 15, and thus act to flush any included bubbles from the surfaces of the lenses. This flow action is equivalent to the device shown in FIG. 2, wherein a rotary motion of the chamber is used to accomplish the same result.

As a further alternative, the lenses may be arranged with their axes horizontal (normal to the lens) and all the lenses simultaneously dipped into the fluid in an elongated tank; not shown, allowing the liquid to flow downward by gravity off the edge of the lens, when the lenses are removed from the tank. After dipping, and while their axes are still horizontal, the lenses may be stationary, or rotating slowly (about 1–5 RPM) around their horizontal axes, and immediately thereafter, the lenses and their supporting means may be inserted in the spinning device for throwing off the excess coating fluid, thereby producing uniform surface coatings.

Further, other suitable means of spacing and supporting the lenses may be employed so long as the said means is adaptable to utilization in the spin coating chamber shown in FIG. 1, whereby the lenses are simultaneously rotated after having been dipped, to centrifugally discard the excess fluid and produce uniform coatings. The spacing of the lenses one above the other with close spacing is useful to protect the coating on the lenses from atmospheric particles, which may otherwise settle upon the wet surfaces.

After the lenses have thus been dipped, and spun in the devices described hereinabove, they are subsequently dried in an air oven as above described.

The coating fluid employed may be of various compositions known in the art which will form abrasion resistant, smooth coatings upon the surfaces of the lenses. The coating composition may also contain various light-absorbing pigments or dyes to absorb infrared, ultraviolet and specific portions of the visible spectrum, as well known to the prior art.

From the foregoing it will be seen that there has been provided apparatus and a method for simultaneously uniformly and quickly coating a large number of articles with a bubble-free, dirt-free layer of optical quality and with a short operating cycle.

Having thus fully disclosed the invention, what is desired to be claimed is:

1. A method for simultaneously coating both surfaces of a plurality of spaced sheet-like members with a bubble-free and dust-free coating material comprising the steps of providing a bubble-free coating material dissolved to form a fluid and imparting a velocity to said fluid, dipping the said sheet-like members into the said fluid, said velocity being substantially parallel to said surfaces of said sheet-like members to wash away any bubbles which may be introduced by said dipping, maintaining the said sheet-like members within said fluid until all surfaces are wetted and washed by the said bubble-free fluid, withdrawing the said sheet-like members from the said bubble-free fluid, a quantity of said fluid being retained in the said spaces between said sheet-like members, spinning the said sheet-like members about a vertical axis, the said surfaces of which are maintained in a horizontal plane, until the excess fluid is centrifugally expelled, and thereafter drying the said coating material remaining on the said surfaces of the said sheet-like members, said spacing between the said surfaces of said sheet-like members being relatively small compared to the width of said sheet-like members, whereby the said bubble-free coating on said sheet-like members is dried while protected from the deposition of atmospheric dust particles thereon.

2. The method according to claim 1 in which the spin of the said sheet-like members is 300 to 3000 RPM.

3. The method according to claim 1 in which the said sheet-like members are spun for a time duration of from 5 to 20 seconds.

* * * * *